US010487828B2

(12) United States Patent
Hibbard

(10) Patent No.: US 10,487,828 B2
(45) Date of Patent: Nov. 26, 2019

(54) SELF-PRIMING POSITIVE DISPLACEMENT PUMP WITH SECTIONED DIVIDING WALL

(71) Applicant: Joe Dick Rector, Hemet, CA (US)

(72) Inventor: Richard Wallace Hibbard

( * ) Notice: Subject to any disclaimer, the term of this patent is extended or adjusted under 35 U.S.C. 154(b) by 123 days.

(21) Appl. No.: 15/530,769

(22) Filed: Feb. 27, 2017

(65) Prior Publication Data

US 2018/0245586 A1 Aug. 30, 2018

Related U.S. Application Data

(63) Continuation-in-part of application No. 10/963,071, filed on Oct. 12, 2004, now Pat. No. 9,581,155.

(51) Int. Cl.

| | |
|---|---|
| ***F04C 2/12*** | (2006.01) |
| ***F04C 15/00*** | (2006.01) |
| ***F04D 25/16*** | (2006.01) |
| ***F04C 18/16*** | (2006.01) |
| ***F04C 2/08*** | (2006.01) |

(52) U.S. Cl.

CPC ..... *F04C 2/126* (2013.01); *F04C 2/084* (2013.01); *F04C 2240/30* (2013.01)

(58) Field of Classification Search

CPC ..... F04C 2/126; F04C 2/084; F04C 2/123; F04C 25/163; F04C 15/0073; F04C 15/06; F04C 15/00; F04C 2/08; F04C 15/0019; Y10T 403/7045; Y10T 403/4628; Y10T 403/4631; Y10T 403/69; F04D 25/163

USPC ..... 418/205, 200, 201.1, 206.2

See application file for complete search history.

(56) References Cited

U.S. PATENT DOCUMENTS

| | | | | |
|---|---|---|---|---|
| 4,057,375 | A * | 11/1977 | Nachtrieb | F04C 2/126 418/189 |
| 4,510,753 | A * | 4/1985 | Steer | B60T 11/20 277/437 |
| 4,943,214 | A * | 7/1990 | Niimura | F01C 1/084 418/150 |
| 8,348,650 | B2 * | 1/2013 | Inagaki | F01C 1/086 277/303 |
| 2006/0083638 | A1 * | 4/2006 | Hibbard | F04C 2/123 417/410.4 |

* cited by examiner

*Primary Examiner* — Deming Wan

(57) ABSTRACT

A rotary, self-priming, positive displacement pump is described. The pump may include a pump housing having a fluid inlet and outlet, first and second rotary impellers having vanes, an input shaft and drive gears synchronizing the impellers to avoid clash, and a dividing wall separating a pumping chamber from a chamber containing the drive gears. The dividing wall separates the pumping chamber from the gear chamber, partially supports impeller shafts, and is formed in a plurality of abutting manually separable sections. When manually pulled apart, the separable sections free the impeller shafts for manual removal, to facilitate manual service to the pump.

7 Claims, 3 Drawing Sheets

SELF-PRIMING POSITIVE DISPLACEMENT PUMP WITH SECTIONED DIVIDING WALL

REFERENCE TO RELATED APPLICATION

This application claims priority of U.S. patent application Ser. No. 10/963,071, filed Oct. 12, 2004, which is incorporated by reference in its entirety, and is related to my copending application entitled "Positive Displacement Pump With Pressure Relief", filed concurrently with the present application.

FIELD OF THE DISCLOSURE

The present disclosure relates to pumps, and more particularly, to a positive displacement pump having rotary, intermeshing impellers.

BACKGROUND

Positive displacement pumps are more useful to pump liquids than other types of pumps, such as centrifugal pumps. A positive displacement pump may be more efficient, may have less variable output flow rates, and may provide still other advantages compared to other types of pumps.

As with all pumps, positive displacement pumps will require maintenance and repairs over time. This is not necessarily easy to accomplish. For example, pump impellers and drive gears may need to be pressed from shafts, and shafts may need to be press fit to supporting structure within the pump. This may require the services of a special facility, such as a machine shop. Where positive displacement pumps are used far from such facilities, repair becomes more time consuming and expensive.

There exists a need to simplify assembly and disassembly operations to facilitate repair, maintenance, and other operations performed on positive displacement pumps.

SUMMARY

The disclosed concepts address the above stated situation by providing in exemplary embodiments a positive displacement pump wherein a pump housing includes a central member having throughbores for supporting impeller shafts, wherein the central member is formed in plural, manually separable sections. This may facilitate disassembly of the pump. Where joints between adjacent ones of the manually separable sections extend through the throughbores, impeller shafts may be released from engagement merely by manually pulling away one or both of the manually separable sections at each end of the central member.

The nature of the disclosed concepts will become readily apparent upon further review of the following specification and drawings.

BRIEF DESCRIPTION OF THE DRAWINGS

Various objects, features, and attendant advantages of the disclosed concepts will become more fully appreciated as the same becomes better understood when considered in conjunction with the accompanying drawings, in which like reference characters designate the same or similar parts throughout the several views, and wherein.

DETAILED DESCRIPTION

Figure 1:
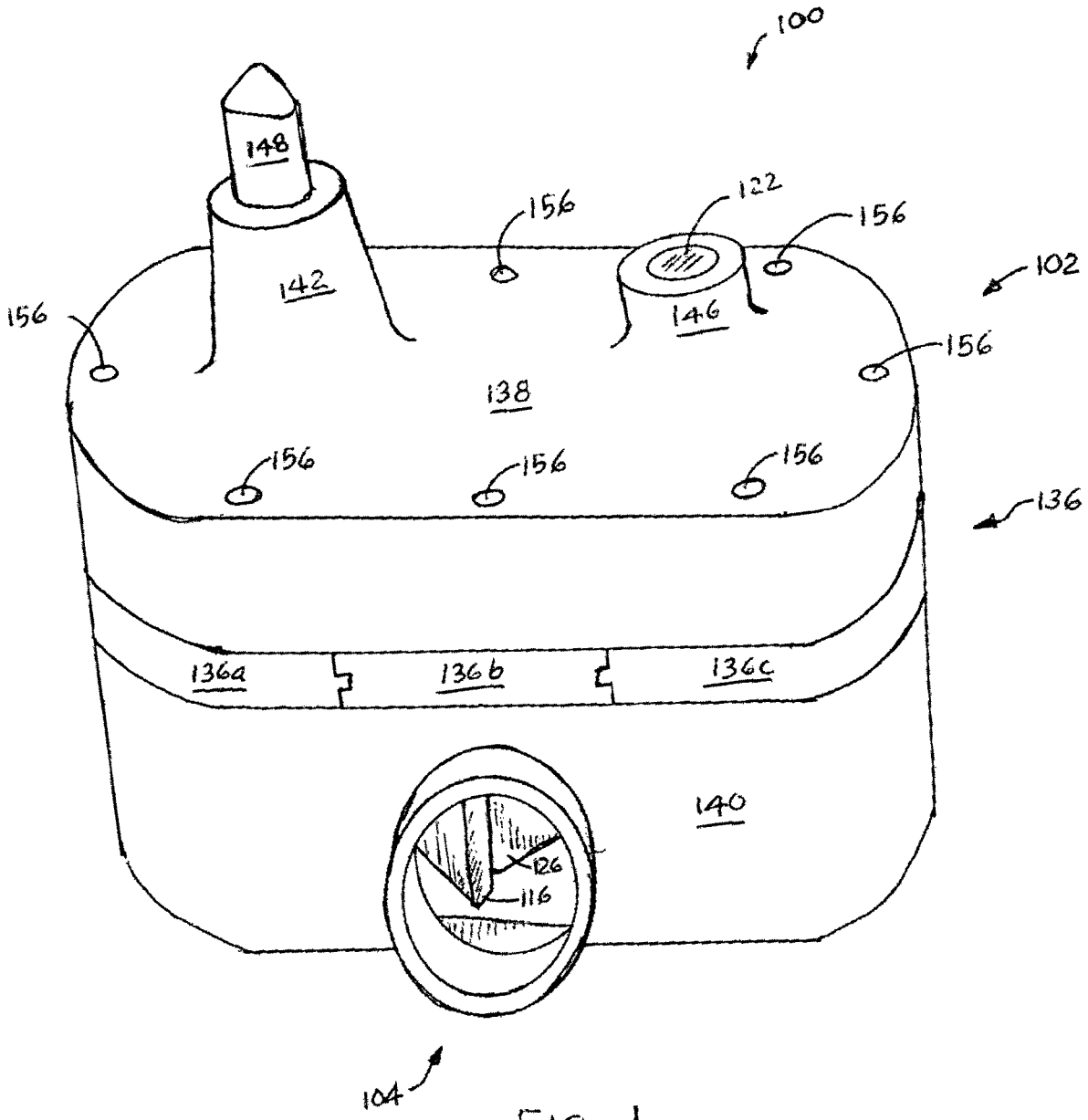
FIG. 1 is a perspective view of the inventive rotary, self-priming, positive displacement pump, in accordance with certain embodiments.
Figure 3:
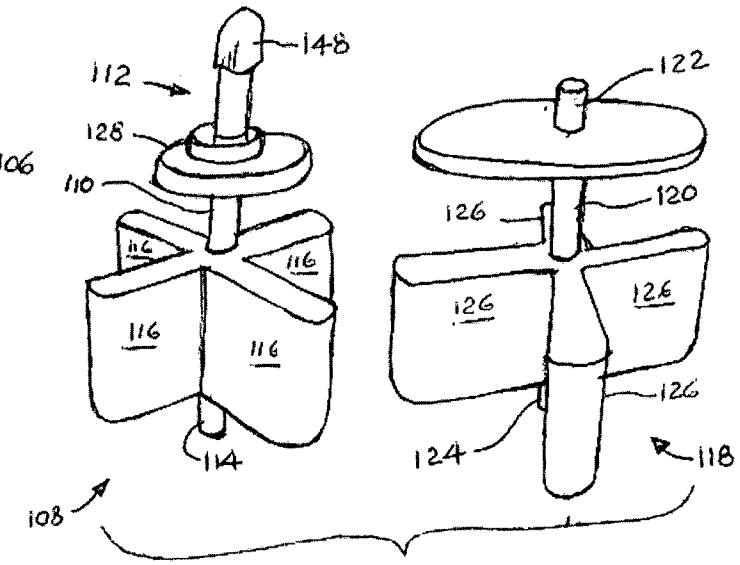
FIG. 3 is an exploded perspective detail view of moving parts mostly internal to the rotary, self-priming, positive displacement pump of FIG. 1, according to certain embodiments.

Referring first to FIGS. 1-4, there is shown a rotary, self-priming, positive displacement pump 100 for pumping fluids (not shown), rotary, self-priming, positive displacement pump 100 comprising a pump housing 102 including a fluid inlet 104 and a fluid outlet 106. Pump 10 further comprises a first rotary impeller 108 in the pump housing 102, first rotary impeller 108 comprising a first shaft 110 including first shaft ends 112, 114 rotatably mounted in the pump housing 102, and wherein the first shaft 110 includes a plurality of vanes 116 extending outwardly therefrom. Rotary, self-priming, positive displacement pump 100 also comprises a second rotary impeller 118 (FIG. 3) in pump housing 102, second rotary impeller 118 comprising a second shaft 120 including second shaft ends 122, 124 rotatably mounted in pump housing 102, and wherein second shaft 120 includes a plurality of vanes 126 extending outwardly therefrom.

Although 100 has been illustrated as having four vanes 116 or 126 for first and second rotary impellers 108, 118, more or fewer vanes 116 or 126 could be used.

Unless otherwise indicated, the terms "first", "second", etc., are used herein merely as labels, and are not intended to impose ordinal, positional, or hierarchical requirements on the times to which these terms refer. Moreover, reference to, e.g., a "second" item does not either require or preclude the existence of, e.g., a "first" or lower-numbered item, and/or, e.g., a "third" or higher-numbered item.

A first gear 128 is secured to first shaft 110, and a second gear 130 is secured to second shaft 120. First gear 128 meshes with second gear 130 and synchronizes rotation of first and second rotary impellers 108, 118 to ensure that vanes 116 of first shaft 110 do not contact vanes 126 of second shaft 120 during rotation.

As shown in the Figures, pump housing 102 comprises three major parts including a first part (a gear cover section 138) enclosing first gear 128 and second gear 130, a second part comprising a dividing wall 136, and a third part (a pumping chamber cover 140) enclosing a pumping chamber 132. Each of the first part, the second part, and the third part has a surface exposed to the exterior of pump housing 102 when the first part, the second part, and the third part are assembled together. These surfaces may occupy a common curved plane as depicted, or alternatively, any of the first part, the second part, and the third part may project to different degrees from pump housing 102 (this option is not shown).

It would be possible to configure rotary, self-priming, positive displacement pump 100 such that dividing wall 136 comprises two rather than three sections (this option is not shown). For example, dividing wall 136 could be divided along an axis perpendicular to ribs 152 and grooves 154, with the axis of division extending through first and second shafts 110, 120 of respective first and second rotary impellers 108, 118. Removal of either of the two sections would free both the first and second rotary impellers 108, 118 for removal.

It would be possible to configure rotary, self-priming, positive displacement pump 100 to have dividing wall 136 be internal to pump housing 102, rather than to have a surface exposed to the exterior of pump housing 102. It would also be possible to configure rotary, self-priming, positive displacement pump 100 such that dividing wall 136 is partially internal and partially exposed to the exterior of pump housing 102.

Figure 4:
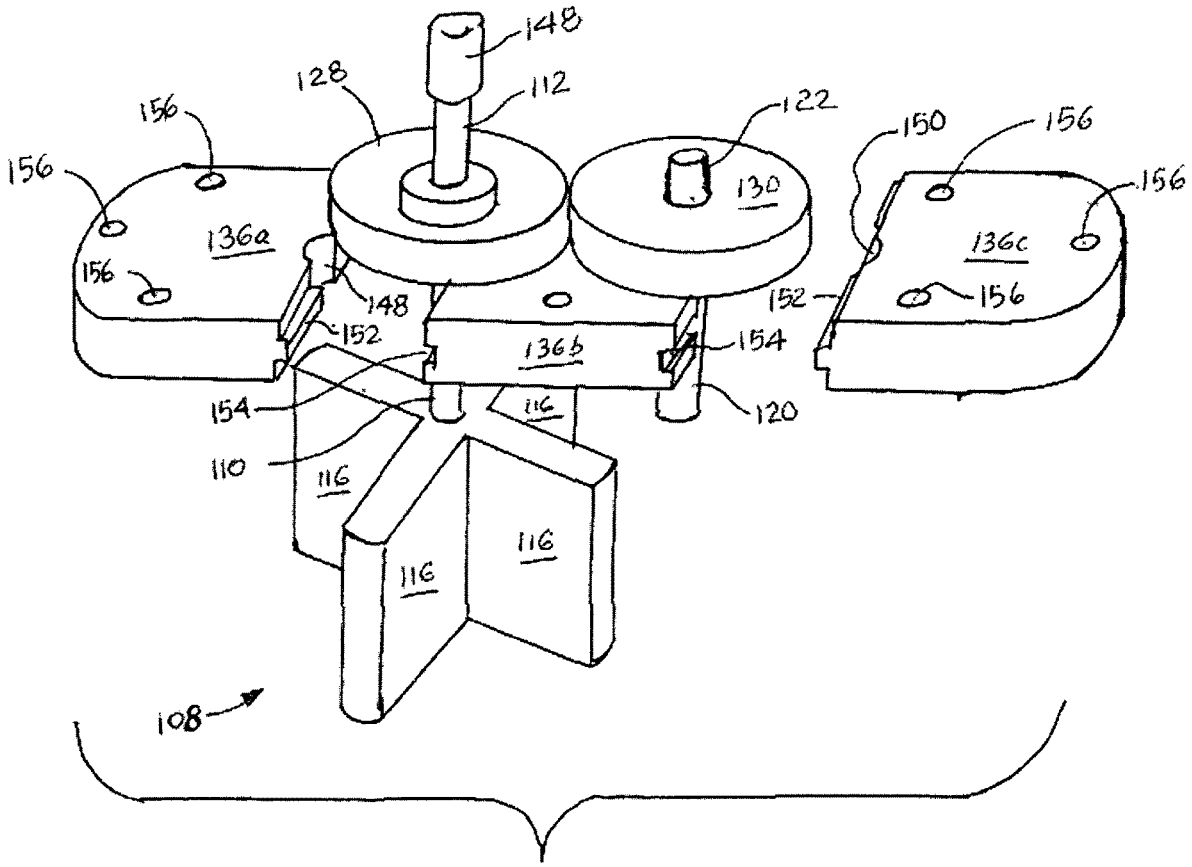
FIG. 4 is an exploded perspective detail view of some of the moving parts of FIG. 3, shown with supporting fixed portions of the rotary, self-priming, positive displacement pump, according to certain embodiments.

Pumping chamber 132 (FIG. 2) is defined within pump housing 102 and a gear chamber 134 is defined within pump housing 102. Dividing wall 136 is within pump housing 102. Dividing wall 136 separates pumping chamber 132 from gear chamber 134, and is formed in a plurality of abutting manually separable sections 136*a*, 136*b*, and 136*c* (FIG. 4). Rotary, self-priming, positive displacement pump 100 may include gear cover section 138, dividing wall 136, and pumping chamber cover 140. Dividing wall 136 is within pump housing 102 in that it may be sandwiched between gear cover section 138 and pumping chamber cover 140.

Figure 2:
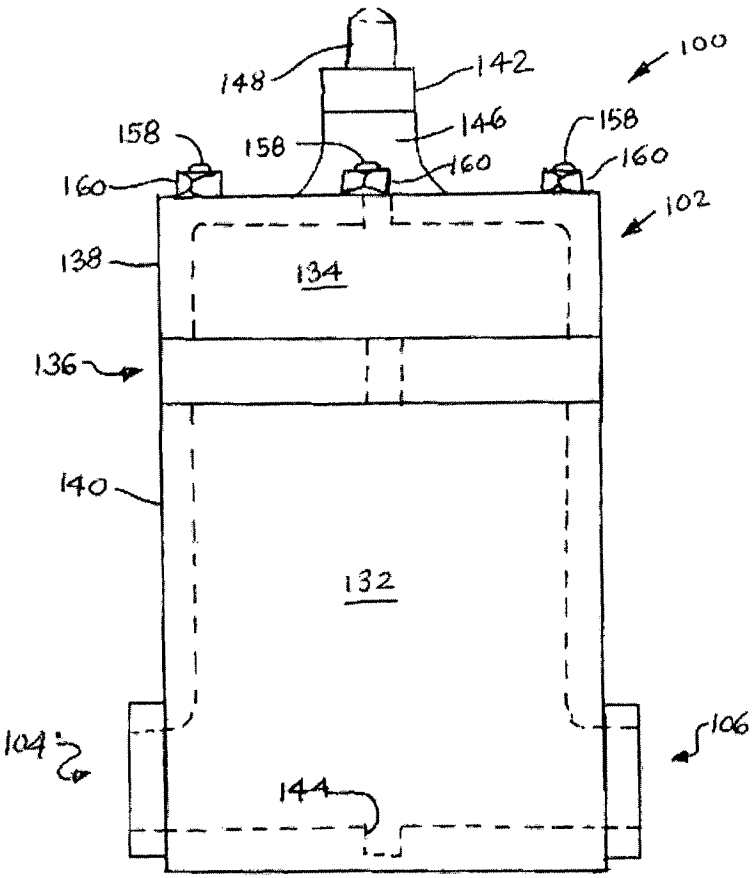
FIG. 2 is a side view of the inventive rotary, self-priming, positive displacement pump of FIG. 1, according to certain embodiments.

Fluid inlet and outlet 104, 106 may project from pump housing 102 as shown in FIG. 2, or may terminate coextensively with an outer surface of pump housing 102. Also, it will be appreciated that fluid inlet and outlet 104, 106 may exchange functions, depending on the direction of impeller rotation.

First shaft end 112 may be journaled within a boss 142 which is part of gear cover 138. First shaft end 114 may be journaled within a bore (not shown) similar to a bore or blind hole 144 (FIG. 2) provided for second shaft 120. Similarly, second shaft end 122 may be journaled in a boss 146 which is a part of gear cover 138. Second shaft end 124 may be journaled in bore 144.

First shaft 110 may be driven via a non-circular enlarged head 148. Although depicted as generally triangular, non-circular head 148 may be no greater in transverse dimension than its associated first shaft 110 if desired. Non-circular head 148 may take configurations other than generally triangular.

First shaft 110 and second shaft 120 each extend through dividing wall 136 between adjacent ones (e.g., 136*a* and 136*b*, or 136*b* and 136*c*) of abutting manually separable sections 136*a*, 136*b*, 136*c*. Removal of at least outermost ones (136*a*, 136*c*) of abutting manually separable sections 136*a*, 136*b*, 136*c* enables removal of first shaft 110 and second shaft 120 from pump housing 102 after exposing first end 112 and second end 114 of first shaft 110 and first end 122 and second end 124 of second shaft 120. Exposing the first and second ends 112, 114, 122, 124 of first and second shafts 110, 120 signifies that pump housing 102 has been disassembled.

Dividing wall 136 may be formed in three manually separable sections including first end separable section 136*a*, central separable section 136*b*, and second end separable section 136*c*. Central separable section 136*b* is between first end separable section 136*a* and second end separable section 136*c*. First end separable section 136*a* contacts first shaft 110. Central separable section 136*b* contacts first shaft 110 and second shaft 120. Second end separable section 136*c* contacts second shaft 120.

Once abutting manually separable sections 136*a* and 136*c* have been pulled away from remaining abutting manually separable section 136*b*, first and second rotary impellers 108, 118 may be easily pulled free for service, inspection, replacement, etc. Referring particularly to FIG. 4, abutting manually separable sections 136*a*, 136*b*, 136*c* may each have a semi-circular recess (e.g., recesses 148 and 150) to partially surround associated first shaft 110 or second shaft 120. Removal of end abutting manually separable sections 136*a*, 136*c* frees first and section shafts 110, 120, enabling ready manual removal.

In prior art pumps (not shown), this may require using a mechanical pump, which may require bringing the prior art pump to a machine shop or other service facility. Because first and second rotary impellers 108, 118 can be manually removed, many repairs formerly requiring special service facilities may be performed in the field.

At least two of abutting manually separable sections 136*a*, 136*b*, 136*c* each have a complementing interfitting element constraining the two abutting manually separable sections 136*a*, 136*b* or 136*b*, 136*c* against mutual movement in at least one axis by interference fit. Referring specifically to FIG. 4, the interfitting element may comprise ribs 152 configured and dimensioned to occupy corresponding grooves 154 in close cooperation therewith. Alternatively stated, a first part of abutting manually separable section 136 abuts a second part (abutting manually separable section 136*b*) at a first interface surface, and the second part abuts a third part (abutting manually separable sections 136*c*) at a second interface surface parallel to the first interface surface. The interface surfaces include ribs 152, grooves 154, and other surfaces of abutting manually separable sections 136*a*, 136*b*, 136*c* seen as vertical as depicted herein.

It should be noted at this point that orientational terms such as vertical refer to the subject drawing as viewed by an observer. The drawing figures depict their subject matter in orientations of normal use, which could obviously change. Therefore, orientational terms must be understood to provide semantic basis for purposes of description only, and do not imply that their subject matter can be used only in one position or orientation.

This arrangement constrains any of abutting manually separable sections 136*a*, 136*b* or 136*b*, 136*c* against movement in the vertical direction as depicted in FIGS. 1-4, relative to any other of abutting manually separable sections 136*a*, 136*b* or 136*b*, 136*c*. This may assist in handling as a unit dividing wall 136 with first and second rotary impellers 108, 118 when these components are assembled together. This may be a convenience in assembling rotary, self-priming, positive displacement pump 100 after disassembly for service.

Manually separable sections 136*a*, 136*b*, 136*c* may be sealed against leaks by gasket, application of a tacky substance, or in any other suitable way.

Pump housing 102 may be secured as a unit by threaded fasteners such as screws, bolts, or studs. To this end, there may be provided a plurality of through holes 156 extending through at least two of gear cover section 138, dividing wall 136, and pumping chamber cover 140. This enables the threaded fastener to be passed through the at least two of gear cover section 138, dividing wall 136, and pumping chamber cover 140 when inserted into any one of through holes 156. It would be possible to have a threaded fastener pass entirely through gear cover section 138, dividing wall 136, and pumping chamber cover 140. Alternatively, a stud may be embedded within gear cover section 138 or pumping chamber cover 140, and would need to pass through only two of the remaining major components of pump housing 102. As depicted in FIG. 2, studs 158 embedded in pumping chamber cover 140 extend through dividing wall 136 and gear cover section 138, projecting from the latter and secured by threaded nuts 160.

Figure 5:
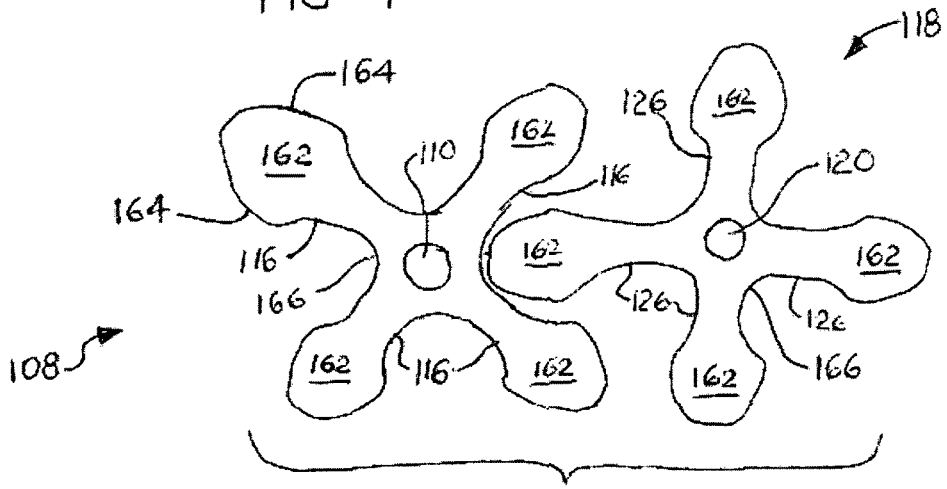
FIG. 5 is a top plan view of an optional configuration of impellers, according to certain embodiments.

Turning now to FIG. 5, vanes 116 and 126 of first rotary impeller 108 and second rotary impeller 118 may have enlarged heads 162 including curved lateral surfaces 164. Junctures 166 of adjacent vanes 116 or 126 may be curved to cooperate with enlarged heads 162. This feature enables closer cooperation between an enlarged head 162 of one vane 116 or 126 and an associated juncture 166 of the other vane 126 or 116, which feature may discourage leakage when pumping. Enlarged heads 162 also accommodate auxiliary structure (not shown herein, but described in my copending application entitled "Positive Displacement Pump With Pressure Relief").

Depending upon pumping chamber design, impeller design, clogs, and possibly other variables, orderly operation of rotary, self-priming, positive displacement pump 100 may be compromised by excessive pressure developing in pressure zones in pumping chamber 132. To forestall such an occurrence, rotary, self-priming, positive displacement pump 100 may be provided with a pressure relief feature comprising, for example, recesses or channels (none shown the above referenced copending application may be consulted for further details on pressure relief) formed in the underside of dividing wall 136 or in the floor or lateral wall of pumping chamber cover 140. These recesses or channels communicate among potential pressure zones to conduct fluid pressure from one zone of high pressure to a zone of lesser pressure. Although pressures may not be rendered equal in all zones of pumping chamber 132, peak pressures may be attenuated to the point that 100 operates satisfactorily.

In the preceding description, numerous specific details are set forth in order to provide an understanding of the present invention. It will be apparent, however, to one skilled in the art that the present invention may be practiced without these specific details. The specific details may be varied from and still be contemplated to be within the spirit and scope of the present disclosure. Many modifications of examples set forth herein will come to mind to one skilled in the art to which the present disclosure pertains having the benefit of the teachings presented in the foregoing descriptions and the associated drawings.

This written description uses examples of the subject matter disclosed to enable any person skilled in the art to practice the same, including making and using any devices or systems and performing any incorporated methods. The patentable scope of the subject matter is defined by the claims, and can include other examples that occur to those skilled in the art. Such other examples are intended to be within the scope of the claims.

The above-described embodiments are intended to be illustrative in all respects, rather than restrictive, of the embodiments. Thus, the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items. Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

I claim:

1. A rotary, self-priming, positive displacement pump for pumping fluids, comprising:

a pump housing having a fluid inlet and a fluid outlet;

a first rotary impeller in the pump housing, the first rotary impeller comprising a first shaft including first shaft ends rotatably mounted in the pump housing, the first shaft including a plurality of vanes extending outwardly therefrom;

a second rotary impeller in the pump housing, the second rotary impeller comprising a second shaft including second shaft ends rotatably mounted in the pump housing, the second shaft including a plurality of vanes extending outwardly therefrom;

a first gear secured to the first shaft and a second gear secured to the second shaft, wherein the first gear meshes with the second gear and synchronizes rotation of the first rotary impeller and the second rotary impeller to ensure that the vanes of the first shaft do not contact the vanes of the second shaft during rotation;

a pumping chamber defined within the pump housing and a gear chamber defined within the pump housing; and a dividing wall within the pump housing, wherein the dividing wall separates the pumping chamber from the gear chamber, and is formed in a plurality of manually separable sections, wherein the first shaft and the second shaft each extend through the dividing wall between adjacent ones of the abutting manually separable sections, whereby removal of at least outermost ones of the abutting manually separable sections enables removal of the first shaft and the second shaft from the pump housing after exposing the first end and the second end of the first shaft and the first end and the second end of the second shaft, and the dividing wall is formed in three said manually separable sections including a first end separable section, a central separable section, and a second end separable section, wherein the central separable section is between the first end separable section and the second end separable section, the first end separable section contacts the first shaft, the central separable section contacts the first shaft and the second shaft and the second end separable section contacts the second shaft.

2. The rotary, self-priming, positive displacement pump of claim 1, wherein at least two of the abutting manually separable sections each have a complementing interfitting element constraining the two of the abutting manually separable sections against mutual movement in at least one axis by interference fit.

3. The rotary, self-priming, positive displacement pump of claim 1, wherein the pump housing comprises three major parts including a first part enclosing the first gear and the second gear, a second part comprising the dividing wall, and a third part enclosing the pumping chamber.

4. The rotary, self-priming, positive displacement pump of claim 3, wherein each of the first part, the second part, and the third part has a surface exposed to the exterior of the pump housing when the first part, the second part, and the third part are assembled together.

5. The rotary, self-priming, positive displacement pump of claim 3, wherein the first part abuts the second part at a first interface surface, and the second part abuts the third part at a second interface surface parallel to the first interface surface.

6. The rotary, self-priming, positive displacement pump of claim 5, further comprising a plurality of through holes extending through at least two of the major parts.

7. The rotary, self-priming, positive displacement pump of claim 1, wherein the vanes of the first rotary impeller and the second rotary impeller comprise enlarged heads including cured lateral surfaces, and the first rotary impeller and the second rotary impeller comprise junctures of adjacent said vanes curved to cooperate with the enlarged heads of the vanes.

* * * * *